US008424713B2

(12) United States Patent
Bolland

(10) Patent No.: US 8,424,713 B2
(45) Date of Patent: Apr. 23, 2013

(54) MULTIPLE CONTAINER RETAINING DEVICE AND METHOD FOR USING SAME

(76) Inventor: Michael J. Bolland, Mesa, AZ (US)

( * ) Notice: Subject to any disclaimer, the term of this patent is extended or adjusted under 35 U.S.C. 154(b) by 701 days.

(21) Appl. No.: 12/640,085

(22) Filed: Dec. 17, 2009

(65) Prior Publication Data

US 2011/0147395 A1 Jun. 23, 2011

(51) Int. Cl.
*B65D 25/00* (2006.01)

(52) U.S. Cl.
USPC ..... 220/739; 220/741; 222/86; 141/329

(58) Field of Classification Search ..... 220/739, 220/741, 742, 743; 222/86; 141/329, 320
See application file for complete search history.

(56) References Cited

U.S. PATENT DOCUMENTS

| | | | | | |
|---|---|---|---|---|---|
| 1,364,889 | A | * | 1/1921 | Rupp | 222/88 |
| 2,488,959 | A | * | 11/1949 | Burbidge et al. | 222/81 |
| 2,786,769 | A | * | 3/1957 | Greenspan | 426/117 |
| 3,024,943 | A | * | 3/1962 | Yeager | 220/742 |
| 3,180,537 | A | * | 4/1965 | Collins | 222/480 |
| 3,285,472 | A | * | 11/1966 | Olson | 222/86 |
| 3,327,881 | A | * | 6/1967 | Maier | 215/6 |
| 3,578,415 | A | * | 5/1971 | Hiltz | 422/166 |
| 3,885,607 | A | * | 5/1975 | Peltier | 141/329 |
| 3,885,672 | A | * | 5/1975 | Westenrieder | 206/503 |
| 4,050,611 | A | * | 9/1977 | Frantz | 222/88 |
| 4,293,015 | A | * | 10/1981 | McGough | 220/739 |
| 4,319,697 | A | * | 3/1982 | De Barth | 222/80 |
| D266,305 | S | | 9/1982 | Scheurer | |
| 4,444,324 | A | * | 4/1984 | Grenell | 215/6 |
| 4,475,914 | A | * | 10/1984 | Portnoff | 604/414 |
| 4,534,391 | A | | 8/1985 | Ventimiglia et al. | |
| 4,603,784 | A | * | 8/1986 | Chang | 215/11.1 |
| 4,671,424 | A | * | 6/1987 | Byrns | 220/592.16 |
| 4,749,162 | A | * | 6/1988 | Wanzor | 248/558 |
| 4,756,424 | A | * | 7/1988 | Schwartz | 206/542 |
| 4,778,141 | A | * | 10/1988 | Bogar | 248/538 |
| 4,782,945 | A | * | 11/1988 | Geiler et al. | 206/203 |
| 4,846,369 | A | * | 7/1989 | Dunstan | 222/86 |
| D304,538 | S | | 11/1989 | Byrns | |

(Continued)

FOREIGN PATENT DOCUMENTS

| | | | |
|---|---|---|---|
| GB | 2370218 | A | 6/2002 |
| JP | 2006168825 | A | 6/2006 |
| WO | 9011713 | A1 | 10/1990 |
| WO | 02100731 | A1 | 12/2002 |

*Primary Examiner* — Anthony Stashick
*Assistant Examiner* — Christopher McKinley
(74) *Attorney, Agent, or Firm* — Schmeiser, Olsen & Watts LLP; Jordan M. Meschkow; Charlene R. Jacobsen

(57) ABSTRACT

A device (20) includes a holder (24) for encircling and holding two containers (76, 96). A tubular structure (22), directed through the holder (24), includes a first tubular portion (52) extending from an outer surface (44) of the holder (24) and a second tubular portion (54) extending from another outer surface (46) of the holder (24). A method of utilization entails placing one container (76) in a sleeve (26) of the device (20) and placing the other container (96) in another sleeve (28) of the device (20). Application of a force (108) causes the tubular portion (52) to pierce the container (76) inside the sleeve (26), and also causes the tubular portion (54) to pierce the container (96) inside the sleeve (28), thereby coupling the containers (76, 96) and enabling transfer of fluid (110, 114) from one container (76) to the other container (96) via the tubular structure (22).

13 Claims, 4 Drawing Sheets

U.S. PATENT DOCUMENTS 4,936,841 A * 6/1990 Aoki et al. ..... 604/413
4,955,503 A 9/1990 Propes
4,964,536 A * 10/1990 Vestering ..... 222/83
5,169,026 A * 12/1992 Patterson ..... 220/740
5,220,949 A * 6/1993 Rufenacht ..... 141/285
5,249,708 A * 10/1993 Magness ..... 222/83
5,279,841 A * 1/1994 Yu ..... 426/131
5,335,809 A * 8/1994 Toida et al. ..... 220/592.27
5,342,346 A * 8/1994 Honda et al. ..... 604/413
5,350,372 A * 9/1994 Ikeda et al. ..... 604/414
5,397,261 A 3/1995 Malewicki et al.
5,415,305 A 5/1995 Drake-Tipton et al.
5,445,631 A * 8/1995 Uchida ..... 604/412
D363,858 S * 11/1995 Sweeney ..... D7/608
5,467,891 A * 11/1995 Perry ..... 220/739
5,555,007 A * 9/1996 Ceschin et al. ..... 347/87
5,638,968 A * 6/1997 Baron et al. ..... 215/11.4
5,667,098 A * 9/1997 Levine et al. ..... 222/1
5,722,540 A * 3/1998 Laird et al. ..... 206/503
5,875,888 A * 3/1999 Albisetti ..... 206/221
5,950,913 A 9/1999 Rea et al.
5,969,592 A * 10/1999 Reed ..... 340/384.1
5,975,336 A * 11/1999 Hart ..... 220/592.17
6,003,715 A * 12/1999 Harris ..... 220/277
6,041,506 A * 3/2000 Iwao ..... 30/443
6,113,257 A * 9/2000 Sharon et al. ..... 366/130
6,123,214 A 9/2000 Goebel
6,182,720 B1 * 2/2001 Barnoski et al. ..... 141/375
D439,802 S * 4/2001 Colmore ..... D7/513
6,237,800 B1 * 5/2001 Barrett ..... 220/505
6,260,590 B1 * 7/2001 Ziegmann ..... 141/332
6,352,177 B1 * 3/2002 Bublewitz et al. ..... 222/82
6,394,643 B1 * 5/2002 Bublewitz et al. ..... 366/172.1
6,415,940 B1 * 7/2002 Brabson, II ..... 220/505
6,439,416 B1 * 8/2002 Hawkins ..... 220/524
6,464,100 B2 10/2002 Canfield
6,948,522 B2 * 9/2005 Newbrough et al. ..... 137/550
6,971,521 B2 12/2005 Pinyot
6,983,861 B2 * 1/2006 Lin et al. ..... 222/83
7,118,005 B2 * 10/2006 Shimazaki ..... 220/737
7,150,369 B1 * 12/2006 Fryar ..... 215/11.4
7,200,967 B1 * 4/2007 Seaman et al. ..... 43/21.2
7,210,508 B2 * 5/2007 Behar ..... 141/329
7,261,707 B2 * 8/2007 Frezza et al. ..... 604/412
7,294,122 B2 * 11/2007 Kubo et al. ..... 604/413
7,302,976 B1 * 12/2007 Bultman ..... 141/364
7,325,912 B2 * 2/2008 Lewey et al. ..... 347/86
7,331,478 B2 * 2/2008 Aljadi ..... 215/11.4
7,413,074 B2 * 8/2008 Barr ..... 206/219
7,571,829 B2 8/2009 Gersovitz
7,762,429 B2 * 7/2010 Macler et al. ..... 222/83.5
7,850,027 B2 * 12/2010 Hayes et al. ..... 215/11.4
7,882,975 B2 * 2/2011 Kelly ..... 220/23.87
8,020,728 B2 * 9/2011 Suchan et al. ..... 222/83
8,172,824 B2 * 5/2012 Pfeifer et al. ..... 604/414
8,251,110 B2 * 8/2012 Bassett et al. ..... 141/319
2002/0087141 A1 * 7/2002 Zinger et al. ..... 604/414
2003/0075548 A1 * 4/2003 Shimazaki ..... 220/737
2003/0075550 A1 * 4/2003 Kenny ..... 220/742
2003/0109846 A1 * 6/2003 Zinger et al. ..... 604/410
2004/0159625 A1 * 8/2004 Kwon ..... 215/329
2004/0225274 A1 * 11/2004 Jansen et al. ..... 604/411
2004/0238563 A1 * 12/2004 Lin ..... 222/81
2005/0121464 A1 * 6/2005 Miller et al. ..... 222/81
2006/0049127 A1 * 3/2006 Katz et al. ..... 215/6
2006/0138154 A1 * 6/2006 Essel ..... 220/737
2007/0017890 A1 * 1/2007 Al-Jadh ..... 215/11.1
2007/0221601 A1 * 9/2007 Eitrheim et al. ..... 215/6
2008/0142030 A1 * 6/2008 Venere et al. ..... 132/116
2008/0142543 A1 * 6/2008 Jones ..... 222/81
2009/0200322 A1 * 8/2009 Hunter ..... 220/737
2010/0263100 A1 * 10/2010 Clement et al. ..... 2/16

* cited by examiner

MULTIPLE CONTAINER RETAINING DEVICE AND METHOD FOR USING SAME

TECHNICAL FIELD OF THE INVENTION

The present invention relates generally to container holders or retaining devices. More specifically, the present invention relates to retaining device for holding two fluid containers and for enabling access to the fluid within those containers.

BACKGROUND OF THE INVENTION

Beverage container insulators, commonly referred to as "koozies," are widely used to provide thermal insulation for beverage containers, such as cans and bottles for soft drinks and beer. These insulators slide over the container to hold the container and to provide an insulating exterior surface, insulating the beverage container from ambient temperature and thus slowing the rate of heat transfer between the ambient environment and the beverage in its container. In addition, such beverage container insulators provide a comfortable covering for holding such a container by the consumer.

A typical beverage container insulator holds a single beverage container, typically a conventional twelve ounce can. There are occasions, however, when a consumer wishes to drink a greater volume of a contained beverage, but may not be continuously near the source of the beverages. For example, a consumer may be moving about in a park, at the beach, or in some other locale and may not be near a convenience store, cooler, or refrigerator. He or she map wish to keep that greater volume of contained beverage cool without the inconvenience of carrying an additional cooler, container insulator, or thermos.

In addition, a consumer may wish to have a blended beverage that is not typically contained in a single container or can. For example, a consumer may wish to drink a blended combination of juice with soda, two different flavors of soda, or two different flavors or styles of beer. Such infinite combinations of beverages suited to a wide variety of palates are not currently available in a single can. Thus, a beverage container insulator that is capable of retaining two beverage containers and that is capable of allowing the blending of two beverages from the two containers would be desirable.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION

Embodiments of the invention entail a device for retaining, or holding, containers and for enabling access to a fluid contained in those containers. More specifically, the device entails a beverage container insulator capable of concurrently retaining and insulating two beverage containers. Furthermore, the device enables access to the beverages contained in each of the two beverage containers to allow blending of the two beverages from the two containers, and to enable the two beverages to be ingested by a consumer via a convention opening into one of the containers. Another embodiment entails a method of utilizing a dual container retaining device to access a beverage contained in a pair of containers retained in the device and to enable transfer of the beverage between containers.

Figure 1:
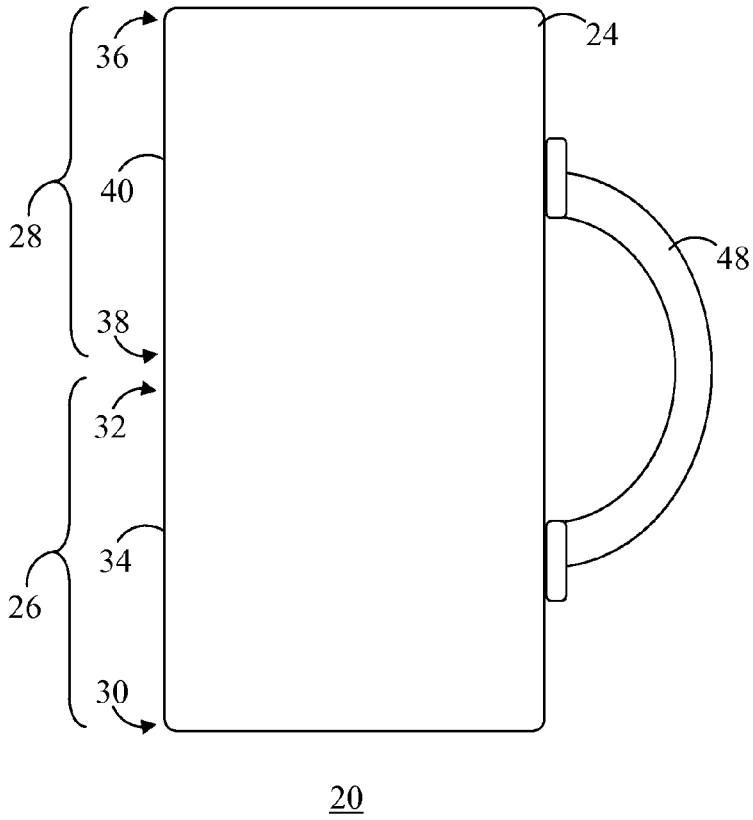
FIG. 1 shows a side view of a device for retaining a pair of containers in accordance with an embodiment of the invention.
Figure 2:
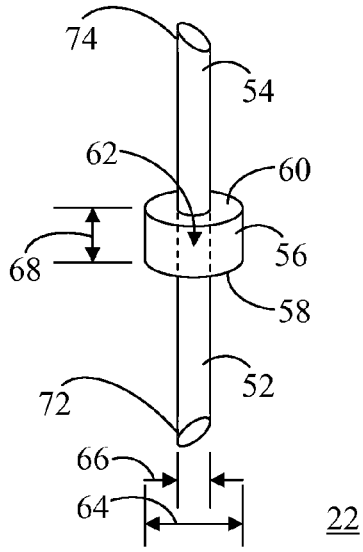
FIG. 2 shows a perspective view of a tubular structure implemented within the device of FIG. 1.
Figure 3:
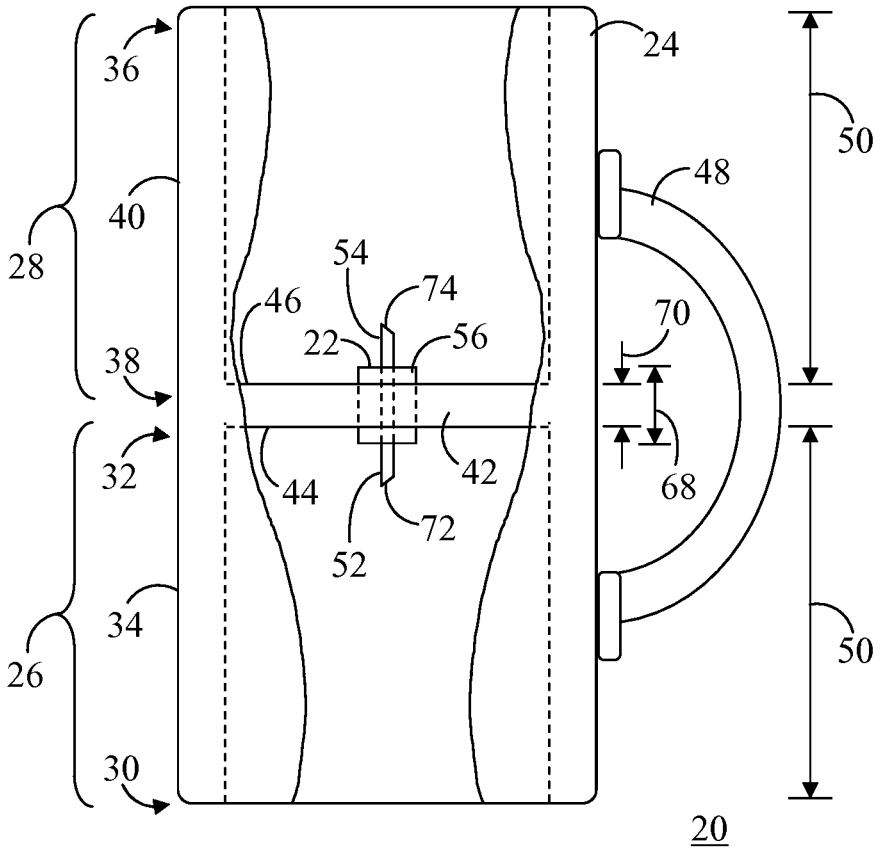
FIG. 3 shows a side cut-away view of the device of FIG. 1.
Figure 4:
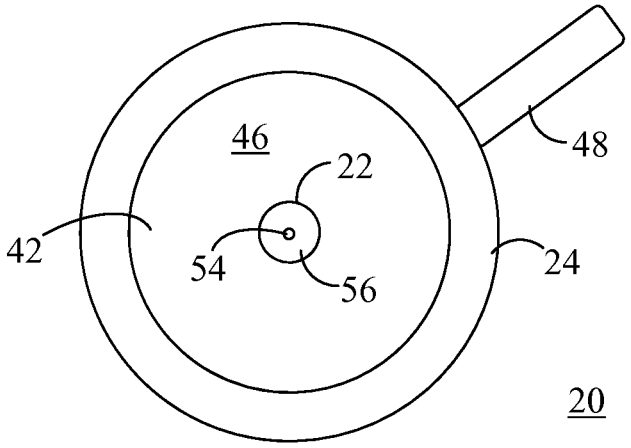
FIG. 4 shows a top view of the device of FIG. 1.

Referring to FIGS. 1-4, FIG. 1 shows a side view of a device 20 for retaining a pair of containers in accordance with an embodiment of the invention. FIG. 2 shows a perspective view of a tubular structure 22 implemented within device 20. FIG. 3 shows a side cut-away view of device 20, and FIG. 4 shows a top view of device 20. In general, device 20 is adapted to retain and insulate a pair of containers (discussed below) and to enable access to a beverage contained in the containers (also discussed below).

Device 20 includes a holder 24 and tubular structure 22 directed through holder 24. Holder 24 is adapted to at least partially encircle and hold the containers. Holder 24 generally includes a first sleeve member 26 and a second sleeve member 28. First sleeve member 26 includes a first open end 30, a first base end 32, and a first peripheral wall 34 extending between first open end 30 and first base end 32. Likewise, second sleeve member 28 includes a second open end 36, a second base end 38, and a second peripheral wall 40 extending between second open end 36 and second base end 38. A transverse support element 42 is interposed between first and second sleeve members 26 and 28 and joins first base end 32 with second base end 38. Transverse support element 42 includes a first outer surface 44 and a second outer surface 46. Device 20 further includes a handle 48 extending between and coupled to first and second sleeve members 26 and 28.

Holder 24 is preferably formed of a suitable flexible, open- or closed-cell, insulating foam material, such as polyurethane, neoprene, and the like. In alternative embodiments, holder 24 may be formed from wool, leather, metals, and so forth. In the embodiment of FIGS. 1-4, each of first and second sleeve members 26 and 28 exhibits a generally circular cross section, visible in FIG. 4. Each of first and second peripheral walls 34 and 40 exhibits a height 50. In the embodiment of FIGS. 1-4, height 50 of each of first and second peripheral walls 34 and 40 is sufficient to encircle approximately an entire height of each of the two containers that are to be held by device 20. The insulating properties, the circular cross-sectional shape of sleeve members 26 and 28, and height 50 of peripheral walls 34 and 40 yields a holder 24 for holding two conventional cylindrical beverage containers that satisfactorily thermally insulates beverages inside the containers from the ambient temperature. Furthermore, handle 48 provides a comfortable grip for holding device 20 by a consumer.

As shown in FIG. 1, first and second sleeve members 26 and 28, respectively, may be formed as a continuous structure without a discrete division between sleeve members 26 and 28. However, in an alternative embodiment, first and second sleeve members 26 and 28 may be separately manufactured and their respective first and second base ends 32 and 38 may subsequently be bonded to form holder 24. In addition, those skilled in the art will recognize that handle 48 may take on a great variation of sizes and shapes and/or may couple to holder 24 at one or more locations. Alternatively, device 20 may be lacking any sort of handle 48 in some embodiments.

Height 50 of first and second sleeve members 26 and 28 enables members 26 and 28 to encircle substantially an entirety of two separate beverage containers in order to insulate the containers from ambient temperature. In alternative embodiments, height 50 may be somewhat or even substantially shorter than the height of the containers intended for use within device 20. In such a configuration, some insulating properties may be sacrificed, while still retaining the capability to transfer beverages between the two containers, which will be discussed below in connection with tubular structure 22. In still alternative embodiments, first and second sleeve members 26 and 28 may include longitudinally aligned slots or regions absent of the insulating foam material to facilitate placement of the beverage containers into and removal of the beverage containers from device 20.

Tubular structure 22 of device 20 includes a first tubular portion 52, a second tubular portion 54, and a base structure 56 interposed between first tubular portion 52 and second tubular portion 54. Base structure 56 includes a first base surface 58, a second base surface 60, and a passage 62 directed through base structure 56 from first base surface 58 to second base surface 60. First tubular portion 52 is coupled to first base surface 58 and second tubular portion 54 is coupled to second base surface 60 so that passage 62 is in fluid communication with each of first and second tubular portions 52 and 54. The term "fluid communication" is intended to mean that fluid, such as a beverage, can enter first tubular portion 52, flow through passage 62, and subsequently flow from passage 62 into second tubular portion 54, where it can then exit from second tubular portion 54. It should be understood that this "fluid communication" can also achieve flow in the opposite direction.

Tubular structure 22 is directed through transverse support element 42 of holder 24 such that first tubular portion 52 extends from first outer surface 44 and second tubular portion 54 extends from second outer surface 46. The location of tubular structure 22 through transverse support element 42 is particularly visible in the side cut-away view of device 20 shown in FIG. 3.

It should be observed that base structure 56 exhibits a diameter 64 that is greater than respective diameters 66 of each of first and second tubular portions 52 and 54. In addition, base structure 56 exhibits a width 68 that is greater than a width 70 of transverse support element 42 between first and second outer surfaces 44 and 46, respectively. Thus, at least one of base surfaces 58 and 60 protrudes from at least one of outer surfaces 44 and 46 into an interior space of at least one of sleeve members 26 and 28. In the illustrated embodiment, both of base surfaces 58 and 60 protrude from respective outer surfaces 44 and 46 into the interior spaces of sleeve members 26 and 28.

First tubular portion 52 includes a first tip 72. Likewise, second tubular portion 54 includes a second tip 74. As will be illustrated below, each of first and second tips 72 and 74 are adapted to penetrate respective beverage containers to enable the transfer of fluid from one of the two containers to another of the two containers through tubular structure 22. Tubular structure 22 is illustrated as being a distinct element from holder 24. Both components may be separately manufactured, and tubular structure 22 may subsequently be installed into holder 24 to form device 20. However, in an alternative embodiment, tubular structure 22 and holder 24 may be fabricated as a continuous structure without discrete division using, for example, a cost effective plastics manufacturing process, such as blow molding.

Tubular structure 22 is illustrated as being approximately centered in transverse support element 42. However, this location of tubular structure 22 is not a limitation of the present invention. In alternative embodiments, tubular structure 22 may be offset from center in accordance design requirements. First tubular portion 52, second tubular portion 54, and base structure 56 are shown with exaggerated lengths and/or widths for clarity of illustration. However, these extended lengths are not a limitation of the present invention. In alternative embodiments, first tubular portion 52, second tubular portion 54, and/or base structure 56 may be formed to different lengths in accordance with design requirements.

Figure 5:
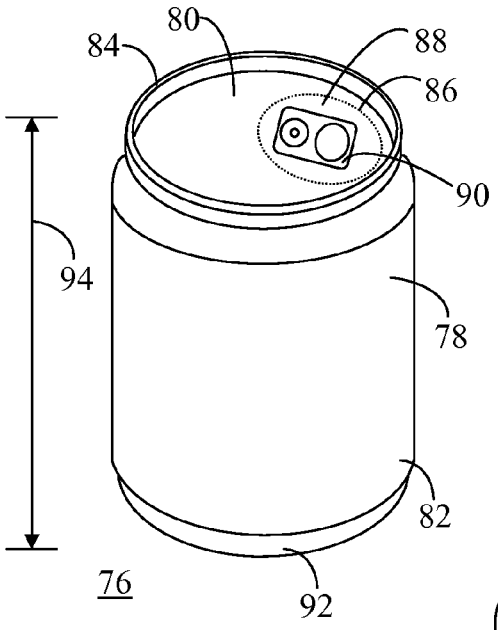
FIG. 5 shows a side perspective view of a container that may be retained in the device of FIG. 1.

FIG. 5 shows a side perspective view of a container 76 that may be retained in device 20. Container 76 may be a conventional beverage can typically used to contain soda, beer, juice, tea, water, and the like. Beverage container 76 has a generally cylindrical body 78, a recessed top 80, and a bottom 82. An annular rim 84 surrounds top 80. Top 80 has a pre-scored opening 86 and a removable element 88 that closes, or seals opening 86. A conventional stay-tab 90 may be implemented to depress removable element 88 into opening 86, or to otherwise remove removable element 88, so as to open beverage container 76. Per convention, bottom 82 may include a circumferential lip 92 having a diameter that is somewhat smaller than cylindrical body 78. Also, per convention, bottom 82 of beverage container 76 may be slightly tapered, or concave.

As mentioned above, each of first and second peripheral walls 34 and 40, respectively (FIG. 3), of first and second sleeve members 26 and 28, respectively (FIG. 3), have height 50 (FIG. 3) sufficient to encircle approximately an entire height 94 of beverage container 76. For example, height 94 may be only slightly greater than height 50.

Figure 6:
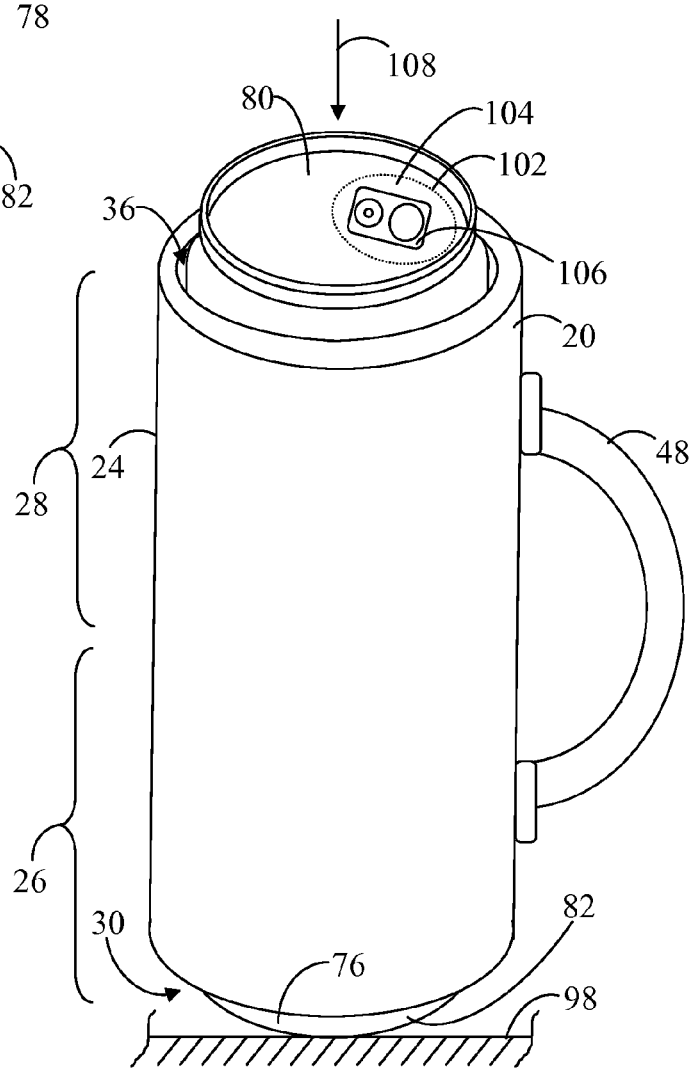
PRIOR ART FIG. 6
FIG. 6 shows a side perspective view of the device of FIG. 1 retaining two containers in accordance with an embodiment of the invention.

FIG. 6 shows a side perspective view of device 20 retaining two containers in accordance with an embodiment of the invention. For example, device 20 may encircle and hold container 76 and a second beverage container 96. This capability advantageously insulates both of containers 76 and 96 from the ambient temperature.

A method for utilizing device 20 entails placing beverage container 76 on a surface 98, such as a table top. In this illustration, beverage container 76 is placed on surface 98 with bottom 82 facing downwardly on surface 98 and top 80 (FIG. 5) facing upwardly. However, if desired, beverage container 76 may be placed on surface 98 with top 80 facing downwardly on surface 98 and bottom 82 facing upwardly, i.e., upside down. Next, device 20 is positioned over beverage container 76 such that first tubular portion 52 (FIG. 3) is placed in abutment with top 80. That is, first open end 30 of first sleeve member 26 is slid over beverage container 76 to position beverage container 76 in an interior cavity of first sleeve member 26.

Second beverage container 96 is then arranged over device 20 with a bottom end (not visible) of container 96 placed in abutment with second tubular portion 54 (FIG. 3). More particularly, second beverage container 96 is slid into an interior cavity of second sleeve member 28 via second open end 36 with the bottom facing downwardly and a top 100 of second beverage container 96 facing upwardly so that its pre-scored opening 102 covered by removable element 104, and a stay-tab 106 are exposed.

Once beverage containers 76 and 96 are appropriately positioned, a downward force, represented by a downwardly directed arrow 108, is applied to containers 76 and 96. In an embodiment, a consumer may push down onto second beverage container 96 with force 108 sufficient to cause penetration of first tip 72 (FIG. 3) of first tubular portion 52 (FIG. 3) into top 80 (FIG. 5) of beverage container 76 and sufficient to cause penetration of second tip 74 (FIG. 3) of second tubular portion 54 (FIG. 3) into the bottom of second beverage container 96. Following application of force 108, containers 76 and 96 are retained in holder 24. The consumer may then open beverage container 96 using stay-tab 106 to enable access to the beverages in each of beverage containers 76 and 96 via opening 102.

The methodology described above employs the application of a single force 108 to cause the concurrent penetration of first and second tubular portions 52 and 54 into beverage containers 76 and 96. In an alternative embodiment, force may first be applied to device 20 and beverage container 76 following the positioning of beverage container 76 in first sleeve 26 but prior to arranging beverage container 96 into device 20. This force will initially cause penetration of first tip 72 of first tubular portion 52 into beverage container 76. Second beverage container 96 can then be arranged in device 20, and a second force can be applied to second beverage container 96 to cause penetration of second tip 74 of second tubular portion 54 into second beverage container 96. This methodology may be useful when device 20 is formed from a rigid material, such as a plastic, and may be effective for enabling penetration of respective first and second tubular portions 52 and 54 into beverage containers 76 and 96 using two applications of lower force.

Figure 7:
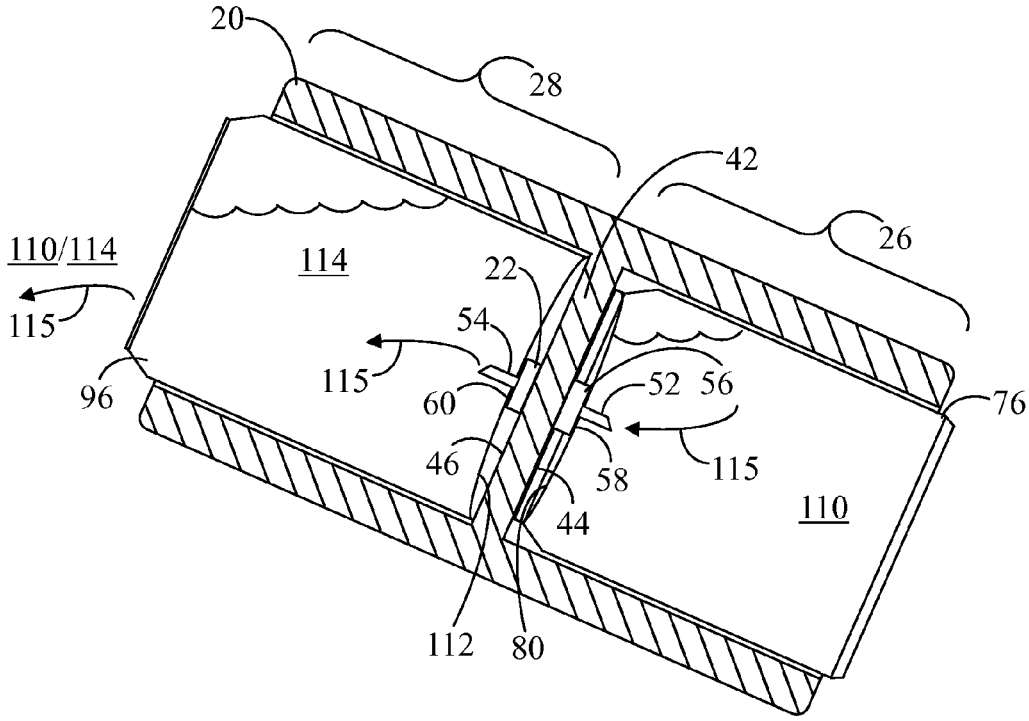
FIG. 7 shows a side sectional view of the device of FIG. 1 with containers housed therein illustrating the transfer of a fluid through the tubular structure of FIG. 2.

FIG. 7 shows a side sectional view of device 20 with beverage containers 76 and 96 housed therein illustrating the transfer of a beverage 110 through tubular structure 22. FIG. 7 further illustrates the orientation of tubular structure 22 relative to beverage containers 76 and 96. As shown, base structure 56 of tubular structure 22 extends from first and second outer surfaces 44 and 46, respectively, of transverse support element 42. Thus, first base surface 58 of base structure 56 rests against recessed top 80 of beverage container 76 and second base surface 60 of base structure 56 rests against a concave bottom surface 112 of beverage container 96 to provide a stable penetration location for first and second tubular portions 52 and 54 and to effectively form a plug for the holes formed in each of top 80 and bottom surface 112 resulting from penetration of first and second tubular portions 52 and 54.

Beverage container 76 houses beverage 110. Beverage container 96 houses another beverage 114 that may be the same or different from beverage 110. The penetration of first and second tubular portions 52 and 54 into beverage containers 76 and 96 enables the transfer of beverage 110 from container 76 into container 96. This transfer of beverage 110 is facilitated by tipping device 20 and allowing the flow of beverage out of opening 102 (FIG. 6) of beverage container 96, such as when a consumer tilts device 20 to drink from beverage container 96. This flow of beverages 110 and 114 is represented by arrows 115.

As beverage 110 flows out of container 76 and into container 96 via tubular structure 22, some mixing or blending of beverages 110 and 114 can occur in container 96. Of course, when device 20 is placed in an upright position again, beverage 114 can also flow through tubular structure 22 into beverage container 76 to further blend beverages 110 and 114. Accordingly, the beverage exiting opening 102 of beverage container 96 can be a blend of beverages 110 and 114, as denoted in FIG. 7 by "110/114." Such capability is desirable to consumers who wish to drink a blended combination of beverages 110 and 114, such as juice with soda, two different flavors of soda, two different flavors or styles of beer, and so forth.

Figure 8:
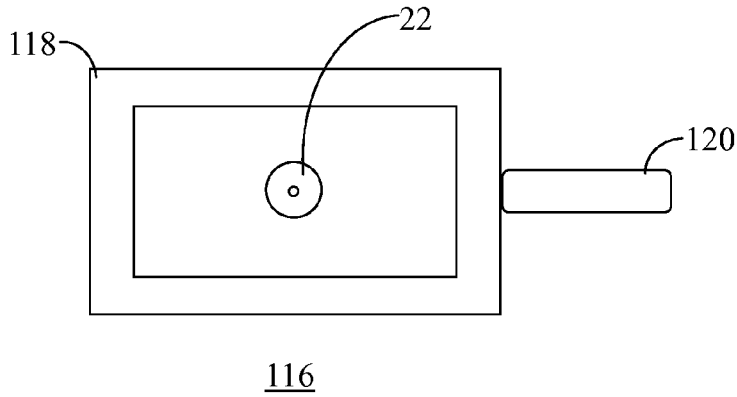
FIG. 8 shows a top view of a device for retaining a pair of containers in accordance with an alternative embodiment of the invention.

FIG. 8 shows a top view of a device 116 for retaining a pair of containers in accordance with an alternative embodiment of the invention. Device 20 (FIG. 1), as illustrated and described, retains two cylindrical containers, or cans. However, the present invention need not be limited to this particular shape of container. Rather, the present invention may be readily adapted to accommodate various shapes of containers. Accordingly, device 116 is largely similar to device 20. That is, device 116 includes a holder 118 for retaining a pair of containers, a handle 120 extending from holder 118, and tubular structure 22. Given their similarity, the details of device 116 need not be repeated. However, in this alternative embodiment, a cross-section of device 116 is rectangular for accommodating generally rectangular-shaped containers (not shown). Such rectangular-shaped containers include, for example, conventional individual use boxes of juice, milk, punch, lemonade, and other flavored beverages typically sold with a straw attached to it.

In summary, the present invention teaches a device for retaining, or holding, containers and for enabling access to a fluid contained in those containers. More specifically, the device entails a beverage container insulator capable of concurrently retaining and insulating two beverage containers. In addition, the device includes a tubular structure that penetrates both of the containers and enables access to the beverages contained in both of the two beverage containers via the tubular to allow blending of the two beverages from the two containers. A method of utilizing a dual container retaining device entails application of a force sufficient to cause penetration of respective tubular portions of the tubular structure into each of two beverage containers. This enables transfer of the beverages between the two containers through the tubular structure. When one container is opened via its conventional opening, the beverages from both containers can flow from this opening for ingestion by a consumer.

Although the preferred embodiments of the invention have been illustrated and described in detail, it will be readily apparent to those skilled in the art that various modifications may be made therein without departing from the spirit of the invention or from the scope of the appended claims. For example, the invention may be adapted to retain containers containing fluids, i.e. liquids and/or gasses, other than beverages that are kept physically separate until their use. In addition, although a device is presented in which containers are coupled end to end via the tubular structure, the present invention may be adapted to retain two containers in a side by side configuration in which the tubular structure penetrates the sides of the two containers instead of the ends of the two containers.

What is claimed is:

1. A device for retaining a first container and a second container comprising:

a holder adapted to at least partially encircle and hold said first and second containers, said holder including a first outer surface configured to face said first container and a second outer surface configured to face said second container, said holder including:

a first sleeve member having a first open end and a first base end;

a second sleeve member having a second open end and a second base end, each of said first and second sleeve members being formed of a flexible, insulating plastic foam; and a transverse support element interposed between said first and second sleeve members to join said first base end with said second base end, said transverse support element including said first outer surface and said second outer surface; and a tubular structure directed through said holder, said tubular structure including a first tubular portion extending from said first outer surface of said holder and a second tubular portion extending from said second outer surface of said holder, said first and second tubular portions being in fluid communication to enable transfer of a fluid through said tubular structure.

2. A device as claimed in claim 1 wherein:

said first tubular portion includes a first tip adapted to penetrate said first container; and said second tubular portion includes a second tip adapted to penetrate said second container to enable transfer of said fluid from one of said first and second containers to another of said first and second containers.

3. A device as claimed in claim 1 wherein said tubular structure further comprises a base structure interposed between said first and second tubular portions, said base structure including first and second base surfaces and a passage directed through said base structure from said first base surface to said second base surface, said first tubular portion being coupled to said first base surface, said second tubular portion being coupled to said second base surface, and said passage being in fluid communication with each of said first and second tubular portions to enable transfer of said fluid through said tubular structure.

4. A device as claimed in claim 3 wherein said base structure exhibits a first diameter that is greater than respective diameters of said first and second tubular portions.

5. A device as claimed in claim 3 wherein said base structure exhibits a first width that is greater than a second width of said holder such that at least one of said first and second base surfaces protrudes from at least one of said first and second outer surfaces.

6. A device for retaining a first container and a second container comprising:

a holder adapted to at least partially encircle and hold said first and second containers, said holder including a first outer surface configured to face said first container and a second outer surface configured to face said second container, said holder including:

a first sleeve member having a first open end and a first base end, wherein said first sleeve member includes a first peripheral wall extending between said first open end and said first base end, said first peripheral wall having a first height sufficient to encircle approximately an entire height of said first container;

a second sleeve member having a second open end and a second base end, wherein said second sleeve member includes a second peripheral wall extending between said second open end and said second base end, said second peripheral wall having a second height sufficient to encircle approximately an entire height of said second container; and a transverse support element interposed between said first and second sleeve members to join said first base end with said second base end, said transverse support element including said first outer surface and said second outer surface; and a tubular structure directed through said holder, said tubular structure including a first tubular portion extending from said first outer surface of said holder and a second tubular portion extending from said second outer surface of said holder, said first and second tubular portions being in fluid communication to enable transfer of a fluid through said tubular structure.

7. A device as claimed in claim 1 wherein each of said first and second sleeve members exhibits a generally circular cross section.

8. A device as claimed in claim 1 wherein each of said first and second sleeve members exhibits a generally rectangular cross section.

9. A device as claimed in claim 1 further comprising a handle coupled to at least one of said first and second sleeve members.

10. A device as claimed in claim 1 wherein said first container is a first beverage container, said second container is a second beverage container, and said fluid is a beverage that is transferable through said tubular structure from said first beverage container to said second beverage container.

11. A device as claimed in claim 10 wherein each of said first and second beverage containers has an opening and a removable element closing said opening, and said device is adapted to expose said opening and said removable element of at least one of said first and second beverage containers for enabling access to said beverage in each of said first and second beverage containers.

12. A method for utilizing a dual container retaining device to access a beverage contained in first and second beverage containers, said second beverage container having an opening and a removable element closing said opening, said device including a holder and a tubular structure directed through said holder, said holder including a first sleeve member having a first open end and a second sleeve member having a second open end, said tubular structure including a first tubular portion extending from a first outer surface of said holder and a second tubular portion extending from a second outer surface of said holder, said first and second tubular portions being in fluid communication to enable transfer of a fluid through said tubular structure, said method comprising:

placing said first beverage container on a surface;

positioning said device over said first beverage container with said first tubular portion in abutment with a first end of said first beverage container, said positioning operation including placing said first beverage container into said first sleeve member via said first open end;

arranging said second beverage container over said device with a second end of said second beverage container in abutment with said second tubular portion, said arranging operation including placing said second beverage container into said second sleeve member via said second open end with said opening and said removable element exposed;

applying force to said first and second beverage containers sufficient to cause penetration of a first tip of said first tubular portion into said first end of said first beverage container and sufficient to cause penetration of a second tip of said second tubular portion into said second end of said second beverage container to enable transfer of said beverage from said first container to said second container, wherein said applying operation further causes said first and second beverage containers to be held in said holder; and removing said removable element to enable access to said beverage in each of said first and second beverage containers via said opening.

13. A method as claimed in claim 12 further wherein said applying operation comprises:

applying said force to said first beverage container following said positioning operation and prior to said arranging operation to initially cause penetration of said first tip of said first tubular portion into said first end of said first beverage container; and applying said force to said second beverage container following said arranging operation to cause penetration of said second tip of said second tubular portion into said second end of said second beverage container.

* * * * *